United States Patent [19]

Nakamura et al.

[11] Patent Number: 4,730,414

[45] Date of Patent: Mar. 15, 1988

[54] WINDOW REGULATOR OF AUTOMOTIVE SASHLESS DOOR

[75] Inventors: Sigeru Nakamura, Odawara; Yukiharu Tokue, Yokohama, both of Japan

[73] Assignees: Nissan Motor Co., Ltd.; Ohi Seisakusho Co., Ltd., both of Yokohama, Japan

[21] Appl. No.: 14,366

[22] Filed: Feb. 13, 1987

[30] Foreign Application Priority Data

Feb. 17, 1986 [JP] Japan ..... 61-30655

[51] Int. Cl.[4] ..... E05F 11/48; E05F 11/52

[52] U.S. Cl. ..... 49/348; 49/349; 49/352; 49/360; 49/374

[58] Field of Search ..... 49/352, 349, 348, 360, 49/350, 351, 374, 375, 211

[56] References Cited

U.S. PATENT DOCUMENTS

| | | | |
|---|---|---|---|
| 3,591,982 | 7/1971 | Nantau | 49/375 X |
| 4,241,542 | 12/1980 | Podolan et al. | 49/375 X |
| 4,420,906 | 12/1983 | Pickles | 49/360 X |
| 4,575,967 | 3/1986 | Bickerstaff | 49/211 |

FOREIGN PATENT DOCUMENTS

| | | |
|---|---|---|
| 3438580 | 4/1986 | Fed. Rep. of Germany . |
| 56-81785 | 7/1981 | Japan . |

*Primary Examiner*—Philip C. Kannan

*Attorney, Agent, or Firm*—Leydig, Voit & Mayer

[57] ABSTRACT

Herein disclosed is a window regulator of a sashless door, which comprises a link motion device which can assume both a contracted condition and an expanded condition. When the window pane is moved up near its full-closed uppermost position, the link motion device changes its condition from the contracted condition to the expanded condition thereby shifting the lower portion of the window pane outwardly, that is, toward the outer panel of the door.

17 Claims, 11 Drawing Figures

WINDOW REGULATOR OF AUTOMOTIVE SASHLESS DOOR

BACKGROUND OF THE INVENTION

1. Field of the Invention

The present invention relates in general to a window regulator particularly for motor vehicles, and more specifically, the present invention is concerned with a window regulator which is appropriate for effecting a flush surface body arrangement of the vehicle.

2. Description of the Prior Art

Nowadays, a so-called "flush surface body arrangement" has been widely applied to motor vehicles, particularly to passenger motor vehicles for the purpose of improving the aerodynamic characteristics and the external appearance of them. The flush surface body arrangement is the arrangement wherein the side surface of the vehicle is smoothed eliminating or at least minimizing any gaps which would appear between the outer surface of each side surface of the vehicle and the outer surface of each door mounted to the side. More specifically, in such arrangement, upon full closing of a window pane of the door in the closed position, the window pane as well as the door proper become substantially flush with the outer surface of the vehicle body.

In the vehicles of a type equipped with sashless doors, however, it has been difficult to practically employ such a flush surface body arrangement because of absence of window sashes by which the window pane is guided during upward and downward movement thereof. Various measures for eliminating such difficulties have been hitherto proposed without obtaining satisfied results.

One of them is the measure which is disclosed in Japanese Patent First Provisional Publication No. 56-81785. In this measure, curved guide rails are stationarily arranged in the door, and rollers connected to a window pane are received in the guide rails to run along the same, so that the closing or upward movement of the window pane induces a gradual shifting of the same toward the outer panel of the door outer panel and finally to its outermost full-closed position wherein the window pane is flush with the surfaces of the door and the vehicle body. However, this measure has also some drawbacks, which are (a) because of usage of numerous guide rails, assembly and adjustment of the window regulator are difficult or at least troublesome; and (b) when assuming a half-open position, the window pane is projected outward by a considerable degree from a window opening of the vehicle thereby deteriorating the aerodynamic characteristics and external appearance of the vehicle.

SUMMARY OF THE INVENTION

It is therefore an essential object of the present invention to provide an improved window regulator which is appropriate for effecting a flush surface body arrangement of the vehicle.

It is another object of the present invention to provide an improved window regulator which does not cause an undersirable outward projection of the window pane from the window opening when the window pane assumes a half-open position.

It is still another object of the present invention to provide an improved window regulator which is easily assembled and easily adjusted.

According to the present invention, there is provided a window regulator for regulating a window pane of a door, which comprises guide means defining an upwardly and downwardly extending given way in the door, a link motion device including a slide member slidable along the given way, a plate member connected to the window pane to move therewith and two pairs of links each having one end pivotally conected to the slide member and the other and pivotally connected to the plate member, the link motion device having both a contracted condition wherein the plate member is positioned close to the slide member and an expanded condition wherein the plate emmber is positioned away from the slide member, biasing means for biasing the link motion device to assume the contracted condition, shifting means for changing the condition of the link motion device from the contracted condition to the expanded condition when the slide member is moved up to a predetermined position of the given way, and driving means for driving the slide member to move upward and downward along the given way of the guide means.

DETAILED DESCRIPTION OF THE INVENTION

Referring to FIGS. 1 to 6, there is shown a window regulator of a first embodiment of the present invention, which is mounted in a side door of a motor vehicle.

The window regulator comprises a pair of spaced guide rails 1A and 1B which are stationarily mounted in the door. As is seen from FIG. 1, these two guide rails 1A and 1B extend in parallel in up-and-down direction when viewed from a direction perpendicular to the major surface of the door. However, as is seen from FIG. 3, the upper portions of the guide rials 1A and 1B are gently curved inwardly, that is, toward an inner panel 4 of the door.

Figure 1:
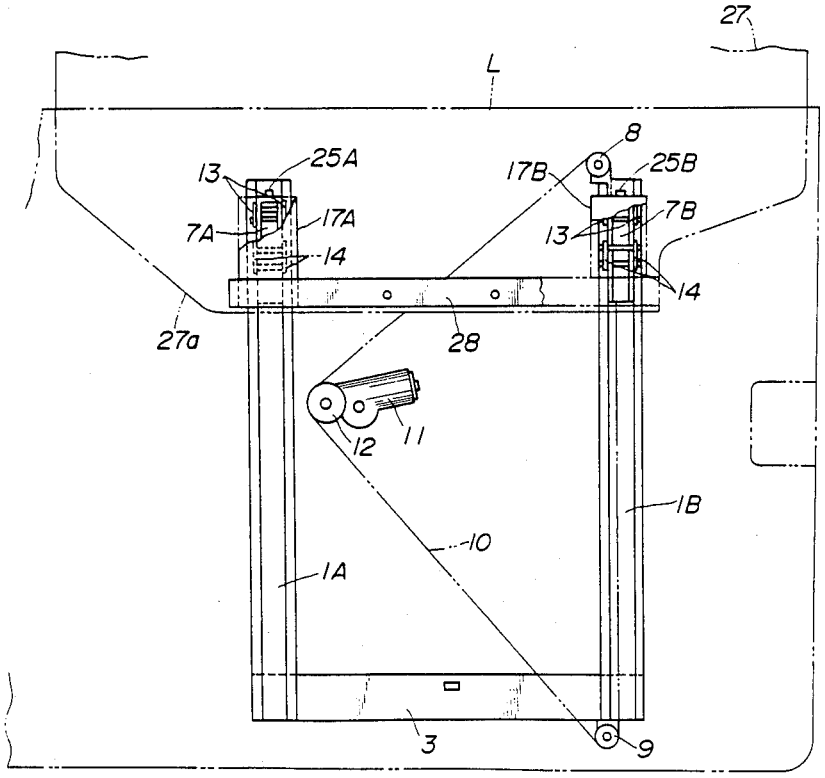
FIG. 1 is a plan view of a window regulator of a first embodiment of the present invention.
Figure 2:
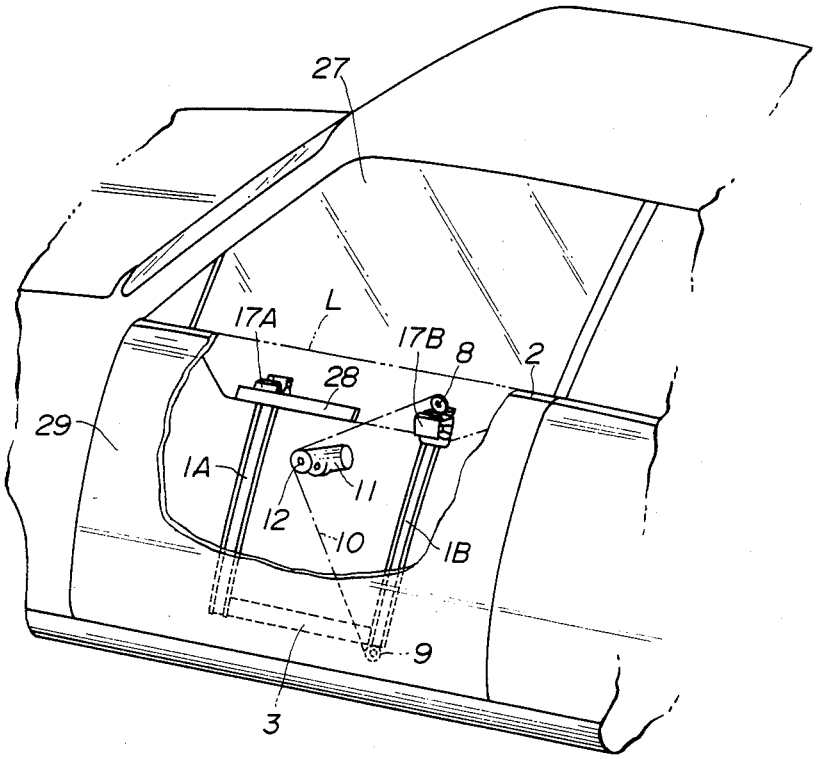
FIG. 2 is a partially broken perspective view of a passenger motor vehicle with a sashless door to which the window regulator of the first embodiment is practically applied.

As is seen from FIG. 1, the two guide rails 1A and 1B extend perpendicular to a waist line "L" which is defined by weather strips 2 (see FIG. 2) mounted on the door proper. The lower ends of the guide rails 1A and 1B are connected through a cross bar 3 which is secured to the inner panel 4 of the door. Thus, it will be appreciated that the position of the two guide rails 1A and 1B relative to the waist line "L" can be adjusted by changing or adjusting the position of the cross bar 3 relative to the inner panel.

Figure 5:
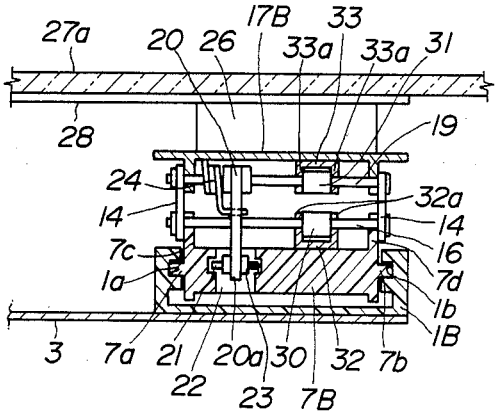
FIG. 5 is a sectional view taken along the line V—V of FIG. 4.

As will be understood from FIG. 5, each guide rail 1B (or 1A) comprises opposed side walls (no numeral) which are constructed to form a so-called channel like member. The opposed side walls are respectively formed at their inner sides with longitudinally extending guide grooves 1*a* and 1*b* which face each other. Slidably engaged with each guide rail 1B (or 1A) is a slide plate 7B (or 7A) which has side ridges 7*a* and 7*b* slidably received in the guide grooves 1*a* and 1*b* of the guide rail 1B (or 1A). As is seen from FIG. 1, upper and lower pulleys 8 and 9 are rotatably connected to the upper and lower ends of the guide rail 1B, and a drive unit consisting of an electric motor 11 and a drive drum 12 is mounted in the door. A drive wire 10 is put around the pulley 8, the drive drum 12 and the pulley 9 with its both ends fixed to the slide plate 7B. Thus, when the drive drum 12 is rotated upon energization of the motor 11, the drive wire 10 moves thereby moving the slide plate 7B upward or downward along the guide rail 1B.

As is seen from FIG. 5, each slide plate 7B (or 7A) is formed at its outward side with opposed walls 7*c* and 7*d* which project away from the guide groove of the guide rail 1B. Two spaced pivot pins 15 and 16 extend across upper and lower portions of the opposed walls 7*c* and 7*d*, respectively. Two pairs of links (13, 13) and (14, 14) are connected at their one ends to the axial ends of the pivot pins, so that these links are pivotal about their associated pivot pins.

Figure 3:
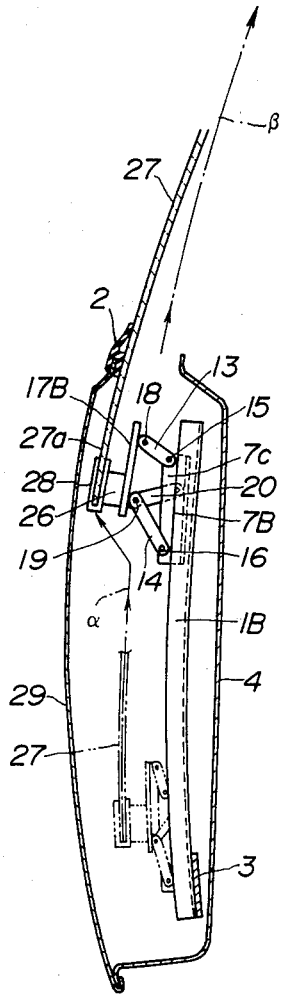
FIG. 3 is a sectional view of the sashless door in which the window reglator is assembled.
Figure 4:
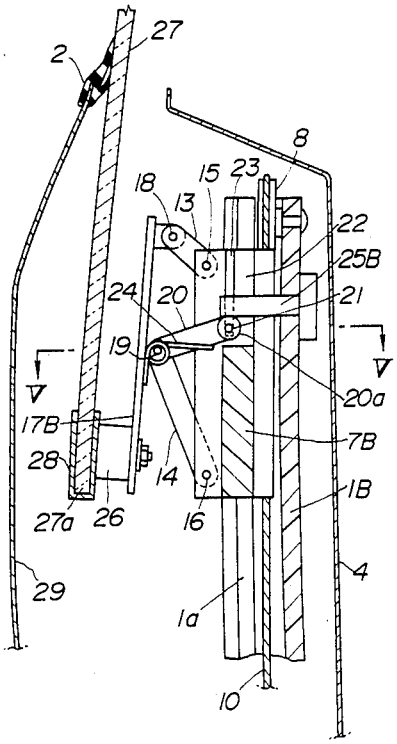
FIG. 4 is an enlarged sectional view of an essential part of the door, showing a condition wherein a window pane is at its full-closed uppermost position.

As will be understood from FIGS. 3 and 4, the leading ends of the links (13, 13) and (14, 14) of each slide plate 7B (or 7A) are pivotally connected to a bracket 17B (or 17A). That is, the bracket 17B (or 17A) comprises opposed side walls (no numerals) across which two spaced pivot pins 18 and 19 extend having the axial ends thereof connected to the leading ends of the above-mentioned links (13, 13) and (14, 14). As is clearly shown by FIG. 4, each slide plate 7B (or 7A), the four links (13, 13) and (14, 14) and each bracket 17B (or 17A) constitute a link motion device with four legs. Thus, by changing the lengthes of each paired links (13, 13) and (14, 14), the mode of pivotal movement of the bracket 17B (or 17A) relative to the slide plate 7B (or 7A) can be changed. In the disclosed embodiment, the length of each link 13 is shorter than that of each link 14, so that the bracket 17B (or 17A) pivots in a clockwise direction as moved leftwardly in FIG. 4, that is, toward the outer panel 29 of the door.

Figure 6:
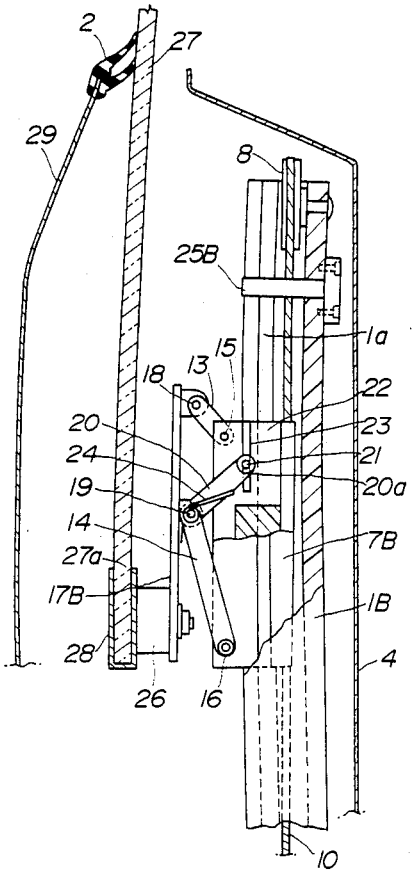
FIG. 6 is a view similar to FIG. 4, but showing a condition wherein the window pane is at its open position.

As is seen from FIGS. 4 and 5, to the pivot pin 19 of each bracket 17B (or 17A), there is pivotally connected one end of an operation link 20 which has a leading end 20*a* equipped with a cross pin 21. The cross pin 21 is slidably received at its axial ends in longitudinally extending grooves 23 formed at the opposed walls of an elongate slot 22 defined by the guide plate 7B (or 7A). As is understood from FIG. 6, the elongate slot 22 extends from the upper extreme end of the slide plate 7B (or 7A) to a generally middle portion of the same, while, the grooves 23 extend from the upper extreme end of the slide plate 7B (or 7A) to a position at a distance about one third of the longitudinal length of the slide plate. As is best seen from FIG. 5, a spring 24 is disposed at its turned section about the pivot pin 19 having one end hooked to the operation link 20 and the other end attached to the bracket 17B (or 17A), so that the operation link 20 is biased to pivot in a counterclockwise direction in FIG. 4 about the pivot pin 19. Due to the biasing force by the spring 24, the paired links 13 and 13 and the other paired links 14 and 14 are biased to rotate in a clockwise direction in FIG. 4 about the respective pivot pins 15 and 16. Thus, in a normal state wherein no external force is applied thereto, the bracket 17B (or 17A) assumes its inwardmost position as shown in FIG. 6 wherein the bracket is located close to the slide plate 7B (or 7A). That is, in this condition, the link motion device assumes a contracted condition.

As is seen from FIG. 4, each guide rail 1B (or 1A) is provided at its upper end portion with a stopper 25B (or 25A) which has a shank portion projected into the guide groove of the guide rail 1B (or 1A). As will be described in detail hereinafter, when each slide plate 7B (or 7A) is moved up to its almost uppermost position, viz. the position shown in FIG. 4, the elongate slot 22 of the slide plate receives therein the shank portion of the stopper 25B (or 25A). Thus, when the slide plate 7B (or 7A) comes up near the uppermost position thereof, the leading end 20*a* of the operation link 20 comes to contact with the shank portion of the stopper 25B (or 25A), thus thereafter, the leading end 20*a* is pressed downward as the slide plate 7B (or 7A) moves toward the uppermost position. Because of the sliding engagement between the cross pin 21 and the grooves 23, the downward pressing by the stopper 25B (or 25A) pivots the operation link 20 in a clockwise direction about the pivot pin 19 causing the two pairs of links (13, 13) and (14, 14) in a counterclockwise direction in FIG. 4. This movement induces a clockwise pivotal movement of the bracket 17B (or 17A) relative to the slide plate 7B (or 7A) increasing the distance between the bracket and the slide plate as will be understood from FIG. 4. That is, during this movement, the link motion device is gradually expanded and finally assumes its full expanded condition.

As is seen from FIGS. 1 and 4, to the lower portions of the two brackets 17B and 17A, there is fixed a cross plate 26 which is secured to a channel-like window pane holder 28. The holder 28 holds a lower portion 27*a* of the window pane 27. Thus, the above-mentioned clockwise pivotal movement of the brackets 17B and 17A induces a clockwise movement of the window pane 27 in FIG. 4 bringing the lower portion of the window pane 27 close to the outer panel 29 of the door.

The window regulator of the first embodiment further comprises stabilizers which stabilize the pivotal movement of the window pane 27. That is, the stabilizers eliminate or at least minimize an undesirable side way motion of the window pane 27 which would be caused by a play of the links (13, 13) and (14, 14). As will become clear as the description proceeds, each stabilizer functions to minimize an axial play of the pivot pin relative to the slide plate 7B (or 7A) or the bracket 17B (or 17A) by which the pivot pin is rotatably supported.

Referring to FIG. 5, there are shown two stabilizers which are practically applied to the connection between the slide plate 7B and the pivot pin 16 and that between the bracket 17B and the pivot pin 19, respectively. One stabilizer comprises a cylindrical member 30 secured to the pivot pin 16 to rotate therewith, and a stopper member 32 secured to the slide plate 7B. The stopper member 32 has opposed side walls 32*a* and 32*a* between which the cylindrical member 30 is received. It is thus necessary to substantially equalize the distance between the side walls 32*a* and 32*a* with the axial length of the cylindrical member 30 so long as such equalization does not induce severe friction therebetween. The other stabilizer comprises a cylindrical member 31 secured to the pivot pin 19, and a stopper member 33 formed with opposed side walls 33*a* and 33*a* and secured to the bracket 17B, which have the same constructions as those of the above-mentioned stabilizer, and thus the axial play of the pivot pin 19 relative to the bracket 17B is eliminated or at least minimized.

Of course, the same stabilizers are equally applied to not only the connection between the slide plate 7B and the pivot pin 15 but also the connection between the bracket 17B and the pivot pin 18. Furthermore, the link motion device associated with the other guide rail 1A is equipped with the same stabilizers.

In the following, operation of the window regulator of the first embodiment will be described with reference to the drawings. For ease of understanding, the description will be commenced with respect to a full-open lowermost position of the window pane 27 which is illustrated by a phantom line in FIG. 3. In this position, as has been mentioned hereinabove, the link motion devices assume their contracted conditions due to the force of the biasing springs 24. Thus, the window pane 27 assumes its inwardmost position which is close to the inner panel 4 of the door.

When, due to energization of the electric motor 11, the drive wire 10 is moved in a direction to pull up the slide plate 7B, the window pane 27 is moved upward making the lower and upper ends thereof travel along the ways $\alpha$ and $\beta$, respectively. It is to be noted that this upward movment of the window pane 27 is smoothly carried out because the way $\alpha$ is positioned away sufficiently from both the inner and outer panels 4 and 29 of the door.

When, due to deenergization of the motor 11, the window pane 27 stops at a half-open position, for example, at the position shown by FIG. 6, the link motion devices keep their contracted conditions because of the forces of the biasing springs 24. Because of this reason and the inwardly curved configulations of the guide rails 1B and 1A as mentioned hereinabove, the upper portion of the window pane 27 is kept positioned inside with respect to an imaginary plane which is flush with the outer surface of the vehicle body. Thus, deterioration of the aerodynamic characteristics (for example, wind noise or the like) and deterioration of the external appearance of the vehicle do not occur.

When thereafter the electric motor 11 is reenergized, the slide plates 7B and 7A are moved upward again toward their uppermost positions lifting the window pane 27 toward its full-closed uppermost position. When, as will be understood from FIG. 4, the slide plates 7B and 7A come up near their uppermost positions, the shank portions of the stoppers 25B and 25A are brought into contact with the leading ends 20*a* of the operation links 20. Thus, thereafter, the link motion devices are quickly expanded as the slide plates 7B and 7A are moved upward, as has been described hereinabove. That is, when the window pane 27 comes up near the full-closed position, the lower end 27*a* of the window pane 27 is quickly shifted outward, that is, toward the outer panel 29 pressing the lower portion of the pane 27 against a weather strip 2 mounted on the waist portion of the door proper. It is to be noted that this outward shifting brings about a clockwise pivotal movement of the window pane 27, as viewed in FIG. 4, due to the pivotal movements of the brackets 17B and 17A as has been described hereinafore. By suitably determining the lengthes of the links 13, 13, 14 and 14 of the link motion mechanism, it is possible to eliminate or at least minimize the outward shifting of the upper end of the window pane 27. In this case, the window pane 27 operates as if it has a pivot center at the top thereof.

When the slide plates 7B and 7A reach their uppermost positions, a known sensor (not shown) senses the reaching and stops energization of the motor 11. With this, the window pane 27 stops at the full-closed uppermost position having the outer surface thereof substantially flush with the outer surface of the door proper and that of the side body of the vehicle. Because the upper end of the window pane 27 makes substantially no inward-and-outward shifting during its upward movement near the full-closed uppermost position, watertight sealing between the upper end of the window pane 27 and a weather strip (not shown) mounted to an upper edge portion of a door opening of the vehicle body is assuredly effected.

When, for opening the window pane 27, the electric motor 11 is energized to move the drive wire 10 in a direction to pull down the slide plate 7B, the window pane 27 is lowered from the full-closed uppermost position. When the window pane 27 is somewhat lowered, the leading ends 20*a* of the operation links 20 become separated from the shank portions of the stoppers 25B and 25A. Thus, thereafter, the downward movement of the slide plates 7B and 7A causes the link motion device to quickly return to their contracted conditions as shown in FIG. 6 by the work of the biasing springs 24. Thereafter, the window pane 27 is moved down to its full-open lowermost position making the lower end thereof travel along the way $\alpha$. Because of the reason as mentioned in the part describing the upward movement of the window pane 27, this downward movement of the window pane 27 is smoothly carried out.

When, the window pane 27 reaches to its full-open lowermost position, a known sensor (not shown) senses this reaching and stops the energization of the motor 11. Thus, the window pane 27 and the link motion device stop at their lowermost positions which are illustrated by phantom lines in FIG. 3.

During the above-mentioned upward and downward movement of the window pane 27, the links (13, 13) and (14, 14) are protected from abnormal stress because of the presence of the stabilizers. That is, when any stress is applied to the links from the window pane 27 through the brackets 17B and 17A during the upward and downward movements of the window pane 27, the stress is almost received by the stabilizers thereby decreasing or minimizing a stress which is applied to the links. Thus, the above-mentioned unique movement of the window pane 27 is smoothly and reliably carried out.

Referring to FIGS. 7 to 11, there is shown a window regulator of a second embodiment of the present invention, which is also mounted in a side door of a motor vehicle.

The window regulator comprises a rectangular base plate 101 which is stationarily mounted in the door. As will become apparent as the description proceeds, the base plate 101 acts as a guide member for the window pane 27. As is seen from FIG. 7, the base plate 101 extends in up-and-down direction when viewed from a direction perpendicular to the major surface of the door. However, as is seen from FIG. 8, the upper portion of the base plate 101 is slightly curved inwardly, that is, toward the inner panel 104 of the door.

Figure 7:
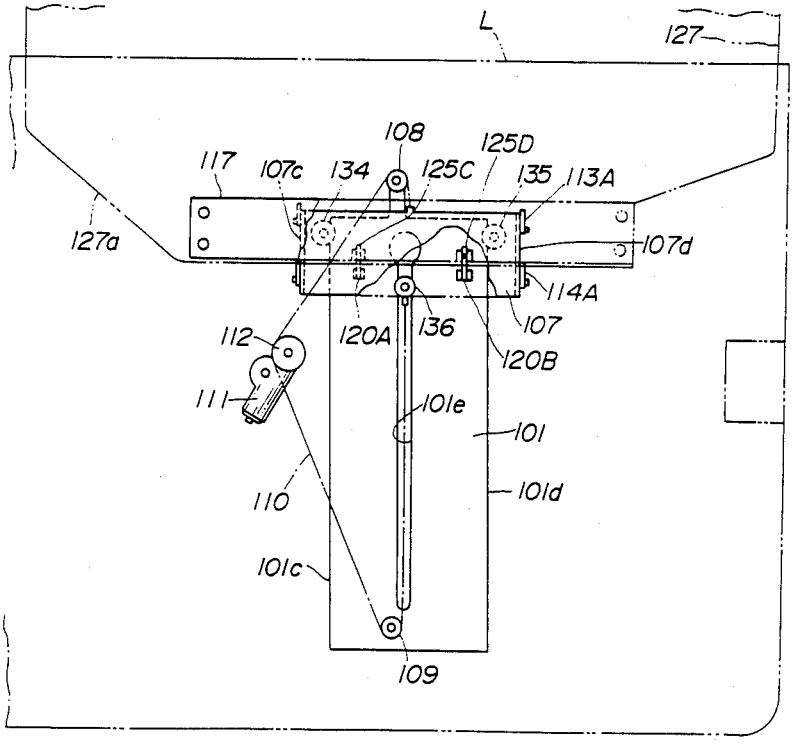
FIG. 7 is a plan view of a window regulator of a second embodiment of the present invention.

As is seen from FIG. 7, the base plate 101 has parallel side edges 101*c* and 101*d* and an elongate slot 101*e* formed therein which is parallel with the side edges 101*c* and 101*d*.

Like in the case of the afore-mentioned first embodiment, the base plate 101 is arranged to extend perpendicular to the waist line "L" of the door proper.

Operatively engaged with the side edges 101*c* and 101*d* and the slot 101*e* of the base plate 101 are respective rollers 134, 135 and 136 which are movable therealong in up-and-down direction in a manner as will be described hereinafter. These rollers 134, 135 and 136 are connected to a slide plate 107 in such a manner that each roller can rotate about an axis perpendicular to the major surface of the slide plate 107, as will be seen from FIG. 7. It is to be noted that the slide plate 107 is placed closer to the outer panel 129 of the door than the base plate 101 is, as is seen from FIG. 9, and the width of the slide plate 107 is greater than that of the base plate 101, as is seen from FIG. 7. Upper and lower pulleys 108 and 109 are rotatably connected to upper and lower portions of the base plate 101, and a drive unit consisting of an electric motor 111 and a drive drum 112 is mounted in the door. A drive wire 110 is put around the upper pulley 108, the drive drum 112 and the lower pulley 109 with its both ends fixed to upper and lower portions of the slide plate 107. Thus, when the drive drum 112 is rotated upon energization of the motor 111, the drive wire 110 is moved thereby moving the slide plate 107 upward or downward along and over the base plate 101 making the rollers 134, 135 and 136 run along the side edges and the slot of the base plate 101.

Figure 9:
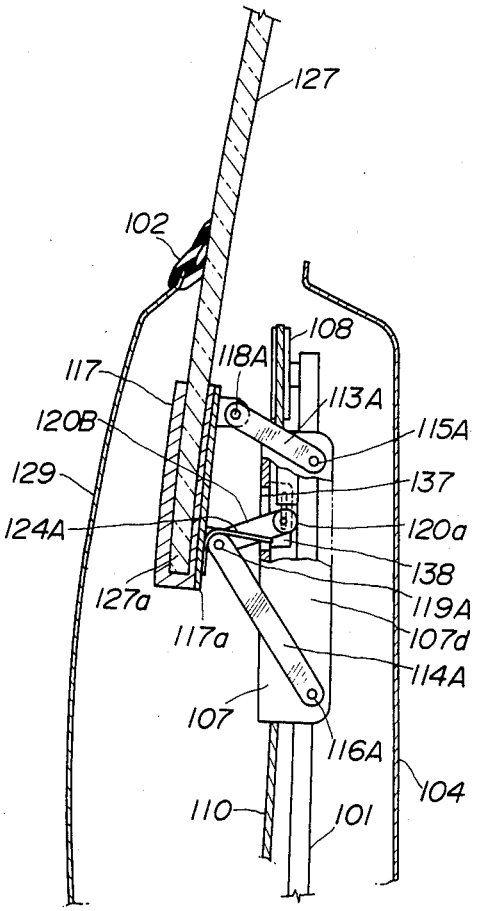
FIG. 9 is an enlarged sectional view of an essential part of the door of FIG. 8, showing a condition wherein a window pane is at its full-closed uppermost position.
Figure 10:
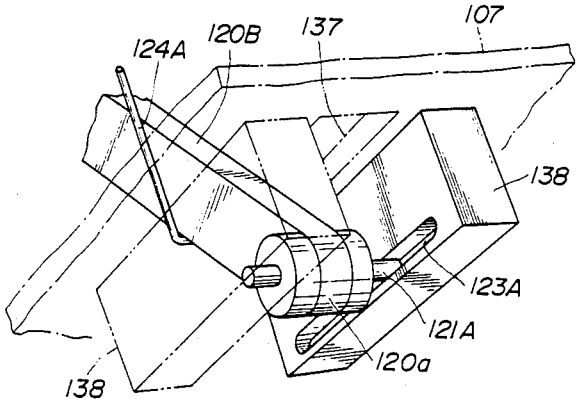
FIG. 10 is an enlarged perspective view of an essential part of an operation link which is employed in the second embodiment.

As is understood from FIG. 9, the slide plate 107 is formed with opposed side walls 107*d* and 107*c* which project toward the inner panel 104 of the door. Two pairs of short pivot pins (115A, 115A) and (116A and 116A) are connected to upper and lower portions of the side walls 107*d* and 107*c*, respectively. Two pairs of links (113A, 113A) and (114A, 114A) are connected at their one ends to the pivot pins (115A, 115A) and (116A, 116A), respectively, so that these links are pivotal about their associated pivot pins.

As will be understood from FIG. 9, the leading ends of the links (113A, 113A) and (114A, 114A) are pivotally connected to an elongate plate 117*a* which is secured to a window pane holder 117. That is, as is best seen from FIG. 11, the elongate plate 117*a* comprises two pairs of spaced pin holders (no numerals). Two long pivot pins 118A and 119A expand between the paired pin holders respectively, so that the pins are rotatable about respective axes relative to the holders. The leading ends of the links (113A, 113A) and (114A, 114A) are connected to the axially opposed ends of the pivot pins 118A and 119A, respectively. Thus, similar to the afore-mentioned first embodiment, the slide plate 107, the four links (113A, 113A) and (114A, 114A) and the elongate plate 117*a* constitute a so-called "link motion device" with four legs. Thus, by changing the lengthes of each paired links, the mode of the pivotal movement of the elongate plate 117*a* relative to the slide plate 107 can be changed. In this disclosed second embodiment, the length of each link 113A is shorter than that of each link 114A, so that the elongate plate 117*a* pivots in a clockwise direction as moved leftwardly in FIG. 4, that is, toward the outer panel 129 of the door.

Figure 11:
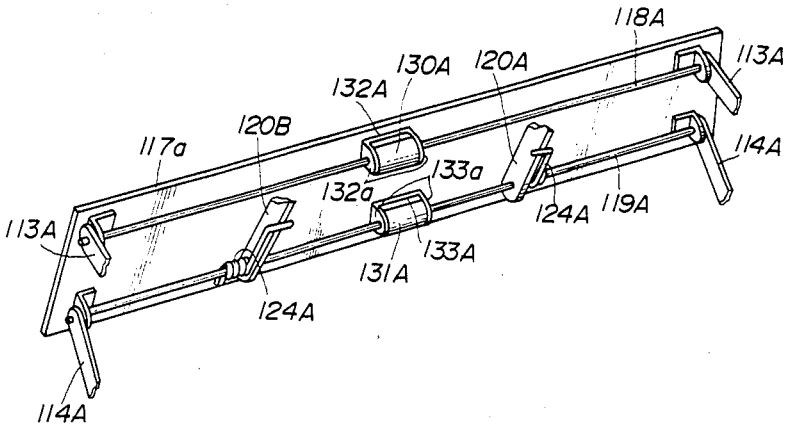
FIG. 11 is a partially broken perspective view of an elongate base plate on which some links are arranged.

As is seen from FIGS. 7, 9 and 11, to the pivot pin 119A of the elongate plate 117*a*, there are pivotally connected one ends of a pair of operation links 120B and 120A, each having a leading end 120*a* equipped with a cross pin 121A (or 121B). As is seen from FIG. 10, each operation link 120B (or 120A) passes through a slot 137 formed in the slide plate 107 and has axial ends of the cross pin 121A slidably received in longitudinally extending grooves 123A which are formed at opposed inner walls of parallel blocks 138 and 138 secured to the slide plate 107.

As is understood from FIG. 11, two springs 124A are disposed at their turned sections about the pivot pin 119A having their one ends hooked to the operation links 120B and 120A and the other ends attached to the elongate plate 117*a*, so that the operation links 120B and 120A are biased to pivot in a counterclockwise direction in FIG. 9 about the pivot pin 119A. Due to this biasing force, the links (113A, 113A) and (114A, 114A) are biased to pivot in a clockwise direction in FIG. 9 about the respective pivot pins 115A and 116A. Thus, in a normal state wherein no external force is applied thereto, the elongate plate 117*a* assumes its inwardmost position wherein the elongate plate 117*a* is positioned close to the slide plate 107. Thus, in this condition, the link motion device assumes its contracted condition.

As is seen from FIG. 7, the base plate 101 is provided with two stoppers 125D and 125C each having a shank portion which is contactable with the leading end 120*a* of one operation link 120B (or 120A) when the slide plate 107 is moved up to its almost uppermost position. Thus, when the slide plate 107 comes up near the uppermost position thereof, the leading ends 120*a* of the operation links 120B and 120A come to contact with the shank portions of the stoppers 125D and 125C, and thus thereafter, the leading ends 120*a* are pressed downward as the slide plate 107 is moved up toward the uppermost position. Because of the sliding engagement of the cross pins 121A and 121B with the grooves 123A of the slide plate 107, the downward pressing by the stoppers 125D and 125C pivots the operation links 120B and 120A in a clockwise direction in FIG. 9 about the pivot pin 119A causing counterclockwise rotation of the links (113A, 113A) and (114A and 114A) about the respective pivot pins 118A and 119A. This movement induces a clockwise pivotal movement of the elongate plate 117*a* relative to the slide plate 107 increasing the distance therebetween, as will be understood from FIG. 9. That is, during this movement, the link motion device is gradually expanded and finally assumes its full expanded condition.

Because the elongate plate 117*a* is secured to the window pane holder 117 which holds the lower portion of the window pane 127, the above-mentioned clockwise movement of the elongate plate 117*a* induces a clockwise pivotal movement of the window pane 127 in FIG. 9 bringing the lower portion of the window pane 127 close to the outer panel 129 of the door.

Similar to the first embodiment as mentioned hereinabove, the window regulator of this second embodiment further comprises stabilizers for the same purpose. That is, as is seen from FIG. 11, each stabilizer comprises a cylindrical member 130A (or 131A) secured to the pivot pin 118A (or 119A) to rotate therewith, and a stopper member 132A (or 133A) secured to the elongate plate 117*a*. The stopper member 132A (or 133A) has opposed side walls 132*a* or 133*a* between which the cylindrical member 130A or 131*a* is received. With these stabilizers, the axial play of the pivot pins 118A and 119A relative to the elongate plate 117A is eliminated or at least minimized.

Although the pivot arrangement between the links (113A and 114A) and the slide plate 107 is somewhat different from that between the links and the elongate plate 117*a* as mentioned hereinabove, the same stabilizers can be practically applied to the pivot arrangement by slightly modifying the short pivot pins (115A, 115A) and (116A, 116A).

Operation of the window regulator of the second embodiment will be described in the following.

Like in the case of the first embodiment, the description will be commenced with respect to the full-open lowermost position of the window pane 127. Under this condition, the link motion device and the window pane 127 assume the positions illustrated by phantom lines in FIG. 8. Furthermore, in this position, the link motion device assumes its contracted condition due to the work of the biasing springs 124A thereby causing the window pan 127 to assume its inwardmost position which is close to the inner panel 104 of the door.

Figure 8:
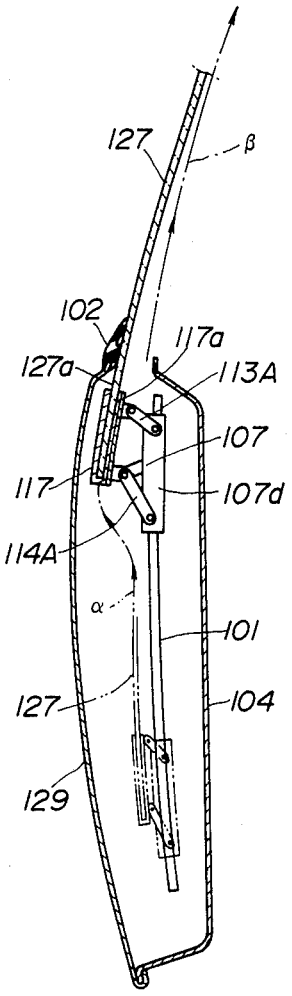
FIG. 8 is a sectional view of a sashless door in which the window regulator of the second embodiment is assembled.

When, due to energization of the electric motor 111, the drive wire 110 is moved in a direction to pull up the slide plate 107, the window pane 127 is moved upward making the lower and upper ends thereof travel along the ways $\alpha$ and $\beta$ of FIG. 8. Because the way $\alpha$ is positioned sufficiently away from both the inner and outer panels 104 and 129, the upward movement of the window pane 127 is smoothly and reliably carried out.

When the window pane 127 stops at a half-open position due to deenergization of the electric motor 111, the link motion device keeps the contracted condition. Because of this reason and the inwardly curved configulation of the base plate 101 as described hereinabove, the upper portion of the window pane 127 is kept positioned inside with respect to an imaginary plane which is flush with the outer surface of the vehicle body.

When thereafter the electric motor 111 is reenergized, the slide plate 107 is moved upward again toward the uppermost position. When, as will be seen from FIG. 9, the slide plate 107 comes up near its uppermost position, the shank potions of the stoppers 125D and 125C are bought into contact with the leading ends 120*a* of the operation links 120B and 120A. Thus, thereafter, the link motion device is quickly expanded as the slide plate 107 is moved upward. This means that when the window pane 127 comes up near the full-closed position, the lower end portion 127*a* of the window pane 127 is quickly shifted outward, that is, toward the outer panel 129 of the door ressing the lower portion 127*a* thereof against a weather strip 102 on the waist portion of the door proper. It is to be noted that this outward shifting brings about a clockwise pivotal movement of the window pane 127, as viewed in FIG. 8, due to the pivotal movement of the elongate plate 117*a* relative to the slide plate 107. Similar to the first embodiment, by suitably determining the lengthes of the links (113A, 113A) and (114A, 114A) of the link motion device, it becomes possible to eliminate or at least minimize the outward shifting of the upper end of the window pane 127. In this case, the window pane 127 operates as if it has a pivot center at the top thereof.

When the slide plate 107 reaches its uppermost position, a known sensor (not shown) senses the reaching and stops the motor 111. With this, the window pane 127 stops at the full-closed uppermost position having the outer surface thereof substantially flush with the outer surface of the door proper and that of the side body of the vehicle.

When, for opening the window pane 127, the electric motor 111 is energized to move the drive wire 110 in a direction to pull down the slide plate 107, the window pane 127 is lowered from the full-closed uppermost position. When the window pane 127 is lowered somewhat, the leading ends 120*a* of the operation links 120B and 120A become separated from the shank portions of the stoppers 125D and 125C. Thus, thereafter, the downward movement of the slide plate 107 causes a quick return of the link motion device to the contracted condition by the force of the biasing springs 124A. Thereafter, the window pane 127 is moved down to its full-open lowermost position making the lower end portion thereof 127*a* travel along the way $\alpha$ in FIG. 8. Because of the reasons as mentioned hereinabove, this downward movement is smoothly carried out.

When the window pane 127 reaches to the full-open lowermost position, a known sensor (not shown) senses this reaching and stops the motor 111. Thus, the window pane 127 and the link motion device stop at their lowermost positions which are illustrated by phantom lines in FIG. 8.

During the above-mentioned upward and downward movement of the window pane 127, the links (113A, 113A) and (114A, 114A) are protected from abnormal external stress because of the presence of the stabilizers. Thus, the unique movement of the window pane 127 is reliably carried out.

As will be understood from the foregoing description, in the window regulators according to the present invention, the following advantageous unique movement of the window pane is achieved. That is, when moved up near its full-closed uppermost position, the window pane is somewhat pivoted inward with its lower end shifted outward. This pivotal movement of the window pane is advantageous in providing the vehicle body with the flush surface arrangement for the reason which has been mentioned hereinafore. Even when the window pane stops at its half-open position, the upper portion of the window pane does not project outwardly from a window opening defined above the door proper. Thus, wind noise problem or the like does not occure. When fully received in the door, the window pane assumes the inward position which is close to the inner panel of the door. This inward positioning is advantageous is avoiding interference with other door control equipments, such as, door opening mechanism, door locking mechanism and the like, which are usually mounted near the outer panel of the door.

What is claimed is:

1. A window regulator for regulating a window pane of a door, comprising:

guide means defining an upwardly and downwardly extending given way in said door;

a link motion device including a slide member slidable along said given way, a plate member connected to said window pane to move therewith and two pairs of links each having one end pivotally connected to said slide member and the other end pivotally connected to said plate member, said link motion device having both a contracted condition wherein said plate member is placed close to said slide member and an expanded condition wherein said plate member is placed away from said slide member;

biasing means for biasing said link motion device to assume said contracted condition;

shifting means for changing the condition of said link motion device from said contracted condition to said expanded condition when said slide member is moved up to a predetermined upper position of said given way; and driving means for driving said slide member to move upward and downward along said given way of the guide means.

2. A window regulator as claimed in claim 1, in which an upper half of said given way is gently curved toward an inner panel of said door.

3. A window regulator as claimed in claim 2, in which one pair of the links of the link motion device are shorter in length that the other pair of the links, so that upon said link motion device assuming said expanded condition, said plate member is inclined toward said slide member with its lower end shifted away from said slide member.

4. A window regulator as claimed in claim 3, in which said two pairs of links are pivotally connected to said slide and plate members through pivot pins which are pivotally held by said slide and plate members.

5. A window regulator as claimed in claim 4, further comprising a motion stabilizer which reduces an axial play of each pivot pin relative to either one of the slide and plate members by which the pivot pin is pivotally held.

6. A window regulator as claimed in claim 5, in which said motion stabilizer comprises a cylindrical member secured to said pivot pin to rotate therewith, and a stopper member secured to either one of said slide and plate members by which said pivot pin is held, said stopper member having opposed walls between which said cylindrical member is intimately but rotatably received.

7. A window regulator as claimed in claim 4, in which said shifting means comprises:

an operation link having one end pivotally connected to said plate member and the other end slidably guided by a groove defined by said slide member; and a stopper stationarily held in said door and having a shank portion to which the other end of said operation link contacts when said slide member is moved up to said predetermined position.

8. A window regulator as claimed in claim 7, in which said operation link is biased by said biasing means in a direction to bias said plate member toward said slide member, said biasing means comprising a coiled spring which is disposed at its turned section about a selected one of the pivot pins with one end thereof hooked to said operation link and the other end thereof attached to said plate member.

9. A window regulator as claimed in claim 7, in which the other end of said operation link is equipped with a cross pin the axial both ends of which are slidably and respectively received in grooves formed in opposed wall portions defined by said slide member.

10. A window regulator as claimed in claim 9, in which said opposed wall portions are opposed walls of an elongate slot which is formed in said slide member.

11. A window regulator as claimed in claim 9, in which said opposed wall portions are opposed inner wall portions of respective blocks which are connected to said slide member.

12. A window regulator as claimed in claim 11, in which said slide member is formed with an elongate slot through which the other end of said operation link passes for the sliding engagement of said cross pin and said grooves of the blocks.

13. A window regulator as claimed in claim 1, in which said guide means comprises two spaced guide rails which are stationarily mounted in the door to extend in upward and downward direction.

14. A window regulator as claimed in claim 13, in which each of said guide rails has opposed side walls which are formed at their inner wall portions with longitudinally extending grooves with which projections formed on said slide member are slidably engaged.

15. A window regulator as claimed in claim 1, in which said guide means comprises:

a rectangular base plate stationarily held in said door, said base plate having parallel side edges which extend in upward and downward direction;

guide rollers rotatably held by said slide member in a manner to run on said parallel side edges of the base plate.

16. A window regulator as claimed in claim 15, further comprising:

means defining in said rectangular base plate an upwardly and downwardly extending slot which is parallel with the parallel side edges of the base plate; and a guide roller rotatably held by said slide member in a manner to slidably engage with said slot of the base plate.

17. A window regulator as claimed in claim 1, in which said drive means comprises an electric motor, a drive drum driven by said motor, a drive wire driven by said drive drum, pulleys rotatably connected to said guide means and putting therearound said drive wire and means connecting both ends of said drive wire to said slide member.

* * * * *